United States Patent [19]

Urban et al.

[11] 4,385,697

[45] May 31, 1983

[54] SHIPPING PACKAGE FOR CRUTCHES

[75] Inventors: Ted F. Urban; Michael J. Willeford, both of Oshkosh, Wis.

[73] Assignee: Lamico, Inc., Oshkosh, Wis.

[21] Appl. No.: 351,854

[22] Filed: Feb. 24, 1982

[51] Int. Cl.[3] ..... B65D 65/02; B65D 71/08; A61H 3/02

[52] U.S. Cl. ..... 206/497; 206/45.31; 206/45.33; 206/223; 206/438; 135/68; 135/71

[58] Field of Search ..... 206/45.31, 45.33, 223, 206/438, 497, 499, 372, 471, 577, 326, 366, 370; 135/68–73

[56] References Cited

U.S. PATENT DOCUMENTS

| | | | |
|---|---|---|---|
| 2,469,366 | 5/1949 | Burbank | 206/499 X |
| 2,876,899 | 3/1959 | Maynard, Jr. | 206/471 |
| 3,338,387 | 8/1967 | Ferry | 206/370 |
| 4,027,687 | 6/1977 | McGowan | 135/68 |

*Primary Examiner*—William T. Dixson, Jr.
*Assistant Examiner*—Bryon P. Gehman
*Attorney, Agent, or Firm*—Andrus, Sceales, Starke & Sawall

[57] ABSTRACT

A shrink wrapped plastic package for shipping crutches. The package includes a pair of crutches disposed in face-to-face relation with each crutch including a pair of side members connected at their central portions by a hand grip and connected at the upper ends by an arm member. The side members, hand grip and arm member define an opening in the crutch. A relatively stiff tray is disposed within the aligned openings of the crutches and the rubber accessories for the crutches, such as the hand pieces, arm pieces, and crutch tips, are disposed in the tray. A plastic shrink wrapped covering surrounds the crutches and encloses the tray and accessories.

8 Claims, 3 Drawing Figures

SHIPPING PACKAGE FOR CRUTCHES

BACKGROUND OF THE INVENTION

It has been traditional to package wooden crutches in lots of six or twelve in corrugated paper cartons for shipment to dealers or distributors. The rubber accessories to be used with the crutches, such as the hand pieces, arm pieces and crutch tips, are not normally packaged with the crutches, and it has been the practice for the dealer, or purchaser, such as a hospital, to separately purchase the accessories and apply them to the crutches.

Because of this manner of marketing, it is necessary for the dealer or hospital to maintain separate inventories of the rubber accessories and as crutches come in a variety of different sizes, this results in a substantial inventory. As the dealer or hospital purchases the rubber accessories in relatively small lots, it is not normally possible to obtain quantity discounts on such small purchases.

Occasionally, because of an inventory problem, the proper accessories may not be available for a particular size crutch, with the result that improperly sized accessories are utilized which can be a safety hazard to the user.

SUMMARY OF THE INVENTION

The invention is directed to a novel package for shipping and handling crutches in which the rubber accessories are packaged with the crutches. In accordance with the invention, a pair of crutches are disposed in face-to-face relation and each crutch includes a pair of side members which are connected at their central portions by a hand grip and are connected at their upper ends by an arm piece. The side members, arm piece and hand grip, define an opening in the crutch, and a relatively stiff tray is disposed within the aligned openings of the pair of crutches and extends longitudinally between the hand grips and the arm piece, as well as extending laterally between the side members of the crutches. The accessories, including the rubber hand pieces, arm pieces and crutch tips, are disposed in the tray and the entire assembly is enclosed in a plastic shrink wrapped covering.

As the rubber accessories are located within the aligned openings in the crutches, which is normally a dead space in shipping, the accessories can be included in the package without increasing the overall size of the package.

The tray not only contains the rubber accessories, but being relatively stiff, also serves to maintain alignment of the pair of crutches during the shrink wrapping operation.

It is contemplated that the back surface of the tray, which is visible through the transparent outer wrap, may contain written material, such as directions for assembly, or crutch size information.

By packaging the rubber accessories with the crutches, size integrity will be insured, meaning that the proper size accessories will be used with the crutches.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figures 1, 2, 3:
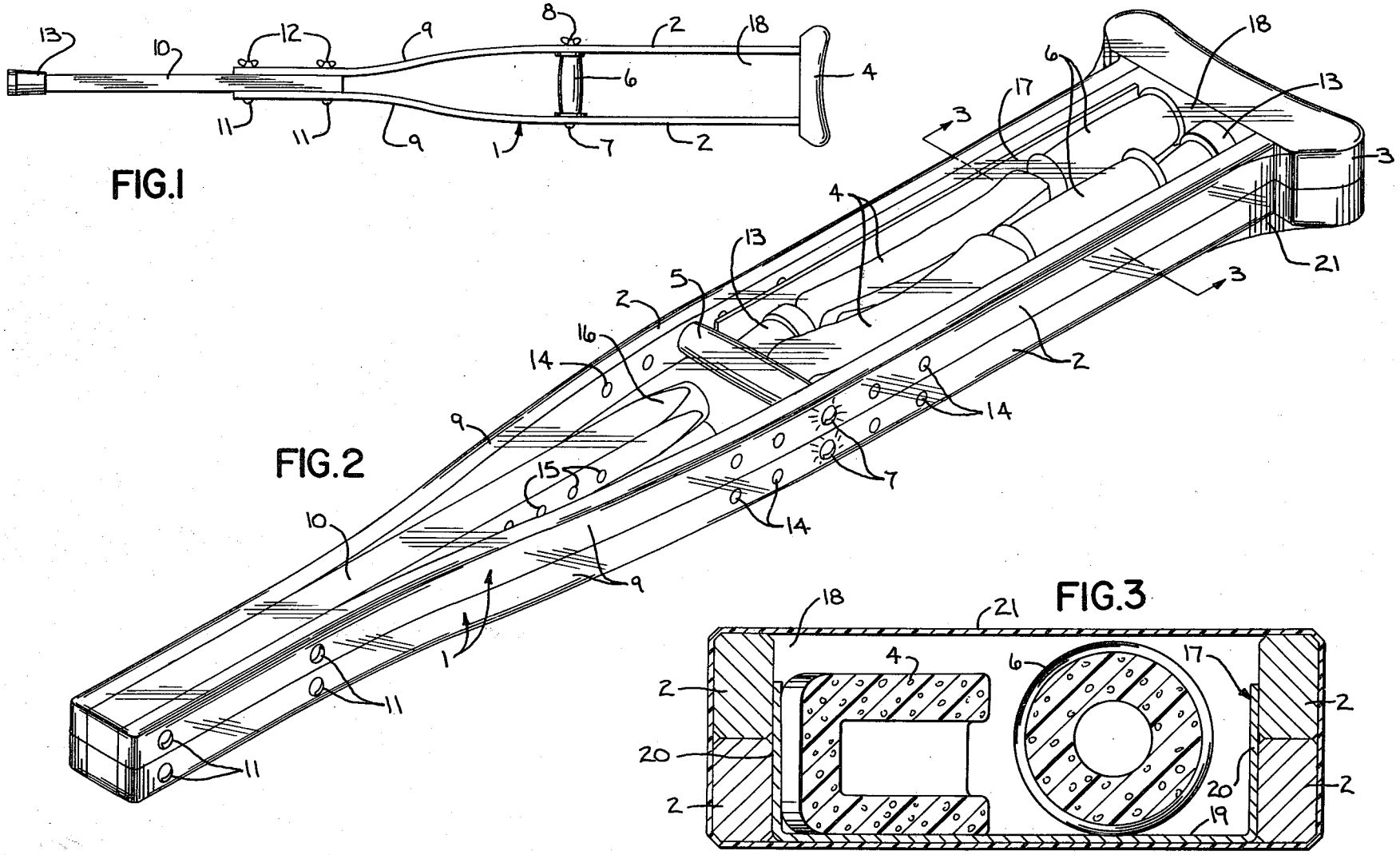
FIG. 1 is a plan view of a crutch in the assembled condition.
FIG. 2 is a perspective view of the package of the invention containing a pair of crutches.
FIG. 3 is a section taken along line 3—3 of FIG. 2.

FIG. 1 illustrates a conventional crutch 1 in the assembled condition, and the crutch 1 includes a pair of side members 2 which are connected at their upper ends by an arm piece 3. A rubber or other resilient cover 4 can be removably secured to the arm piece 3.

The central portions of side members 2 are connected by a hand grip 5 which is also covered by a rubber or resilient covering 6. To connect the hand grips 5 to the side members 2, a bolt 7 extends through aligned openings in the side members and hand grip and the end of the bolt receives a wing nut 8.

The lower ends 9 of the side members 1 converge inwardly, and a lower member 10 is connected between ends 9 by bolts 11 which receive wing-nuts 12. A plastic or rubber tip 13 is attached to the lower end of member 10.

To provide adjustment for the hand grip 5, the side members 2 contain a series of spaced holes 14 and the bolt 7 can be inserted through the proper aligned pair of holes to provide the desired position for the hand grip 5. Similarly, the lower member 10 is provided with a series of holes 15 and the bolts 11 can be inserted through the proper holes 15 to provide the desired length for the crutch.

In accordance with the invention, a pair of crutches 1 are packaged for shipment and handling as illustrated in FIGS. 2 and 3. In the package, the lower member 10 of each crutch is reversed in position so that the tip 16 of lower member 10 is in approximate relation to the hand grip 5, as shown in FIG. 2. The crutches are disposed in aligned face-to-face relation and a tray 17, being generally U-shaped in cross section, is disposed within the aligned upper openings 18 of the crutches. As best illustrated in FIG. 3, the tray 17 is provided with a central web 19, which is disposed generally flush to the outer surface of one of the crutches 1, and a pair of sides 20 which extend outwardly from the web and are positioned in proximate relation to the side members 2.

As shown in FIG. 2, tray 17 serves to contain the arm piece covers 4, the hand grip covers 6, and the tips 13, for both of the crutches. In addition, tray 17 extends between the arm piece 3 and hand grip 5, as well as extending between the side members 2, to thereby maintain alignment of the crutches during the plastic shrink wrap packaging.

The pair of crutches 1, as well as the rubber accessories contained within tray 17 are enclosed by a shrink wrapped plastic covering 21.

The shrink wrap covering 21 is applied in a conventional manner in which the assembly of crutches 1, tray 17 and accessories, is inserted within a bag or envelope of thermoplastic material, such as polyethylene or polyvinylchloride, and the open edges of the bag or envelope are then heat sealed. Subsequently, the sealed package is heated causing the plastic film to shrink to provide a tight secure enclosure.

It is contemplated that the back surface of the web 19 of tray 17, which is visible through the plastic wrap 21, can bear written or decorative material, as for example, instructional material describing the assembly of the crutches, or an indication of the size of the packaged crutches.

The invention provides an inexpensive, yet secure, package for a pair of crutches, along with the rubber accessories. As all of the components are contained within the confines of the crutch itself, the overall size of the package is not increased over that of a conventional crutch shipping package.

By virtue of the transparent wrap 21, the contents of the package, as well as written material on the back side of the tray, is visible to the purchaser.

As the rubber accessories, such as covers 4 and 6, and tips 13, are contained with the crutches, it insures that the proper arm and head piece covers and tips are utilized. Packaging the accessories with the crutches also eliminates the need for dealers and hospitals to maintain an inventory of the rubber accessories. This not only reduces the inventory but also eases the administrative burden of purchasing these items.

Various modes of carrying out the invention are contemplated as being within the scope of the following claims particularly pointing out and distinctly claiming the subject matter which is regarded as the invention.

I claim:

1. A shipping package for crutches, comprising a pair of crutches disposed in face-to-face alignment, each crutch having a pair of side members and having an arm piece connecting the upper ends of the side members and having a hand grip connecting the central portions of the side members, the side members, arm piece and hand grip of each crutch defining an opening, said openings being disposed in alignment, a container disposed within said aligned openings and extending longitudinally between said arm pieces and said hand grips and exending laterally between said side members, a plurality of rubber-like accessories disposed within the container, and a heat shrunk plastic covering enclosing said crutches and said accessories.

2. The package of claim 1, wherein said accessories include a pair of covers for said arm pieces, a pair of covers for said hand grips and a pair of crutch tips.

3. The package of claim 1, wherein said container comprises a tray having a generally U-shaped cross section and including a central web and a pair of sides extending outwardly from said web, said tray defining a compartment to receive said accessories.

4. The package of claim 3, wherein said covering is formed of transparent thermoplastic film.

5. The package of claim 4, wherein the back surface of the web of said tray contains written material which is visible through said transparent covering.

6. A shipping package for crutches, comprising a pair of crutches disposed in face-to-face alignment, each crutch having a pair of side members and having an arm piece connecting the upper ends of the side members and having a hand grip connecting the central portions of the side members, the side members, arm piece and hand grip of each crutch defining an opening, said opening being disposed in alignment, a tray disposed within the aligned openings and being generally U-shaped in cross section and including a central web and a pair of sides extending outwardly from said web, said web being disposed generally flush with the outer surface of one of said crutches and said sides being in proximate relation to the aligned side members of said crutches, a plurality of rubber-like accessories including a pair of arm piece covers, a pair of hand grip covers, and a pair of crutch tips disposed within the tray, and a heat shrunk thermoplastic cover enclosing said crutches and said accessories, said cover being transparent and said accessories being visible through said transparent cover.

7. The package of claim 6, wherein said tray extends longitudinally between said hand grips and said arm pieces of said pair of crutches and said tray extends laterally between the aligned side members of said pair of crutches, said tray restricting relative longitudinal and lateral movement of said aligned crutches.

8. A shipping package for crutches, comprising a pair of crutches disposed in face-to-face alignment, each crutch having a pair of side members and having an arm piece connecting the upper ends of the side members and having a hand grip connecting the central portions of the side members, the side members, arm piece and hand grip of each crutch defining an opening, said openings being disposed in alignment, the lower ends of each pair of side members converging inwardly, an end member disposed between the converging lower ends of said side members and disposed in a reversed position with regard to its normal position of use with the normal lower end of said end member being disposed in proximate relation to said hand grip, a plurality of rubber-like accessories including a pair of arm piece covers, a pair of hand grip covers, and a pair of crutch tips disposed within the aligned openings, and a heat shrunk thermoplastic covering enclosing said crutches and said accessories, said covering being transparent and said accessories being visible through said transparent covering.

* * * * *